United States Patent [19]

Boogers

[11] Patent Number: 4,505,281

[45] Date of Patent: Mar. 19, 1985

[54] METHOD AND DEVICE FOR DIVIDING A WHOLE OR A HALF A TOBACCO LEAF INTO USABLE PORTIONS, FOR EXAMPLE, BINDERS OR WRAPPERS

[75] Inventor: Wilhelmus P. L. Boogers, Eindhoven, Netherlands

[73] Assignee: B. V. Arenco P.M.B., Best, Netherlands

[21] Appl. No.: 399,833

[22] Filed: Jul. 19, 1982

Related U.S. Application Data

[63] Continuation of Ser. No. 162,431, Jun. 24, 1980, abandoned.

[51] Int. Cl.[3] ..... A24C 1/04; A24C 1/28

[52] U.S. Cl. ..... 131/105; 83/72; 83/73

[58] Field of Search ..... 131/105; 83/71–75, 83/510, 564, 370, 371

[56] References Cited

U.S. PATENT DOCUMENTS

| | | | |
|---|---|---|---|
| 4,204,145 | 5/1980 | Hevenor et al. | 131/280 |
| 4,223,684 | 9/1980 | Boogers et al. | 131/105 |
| 4,261,374 | 4/1981 | Wood | 131/105 |
| 4,296,405 | 10/1981 | Rich | 131/105 |

*Primary Examiner*—V. Millin

*Attorney, Agent, or Firm*—Diller, Ramik & Wight

[57] ABSTRACT

A method and a device for dividing a whole or half a tobacco leaf into usable portions, for example, binders or wrappers, in which the tobacco leaf is spread on two or more contour knives, the cutting edges of which are pressed across the material of the tobacco leaf, wherein the punched-out tobacco leaf portions are lifted out of the contour knives, and deposited on a carrier by means of a suction box conveyor; the leaf portions are subsequently scanned by a scanning apparatus having an electronic processing and control circuitry, controlling pick-up means to pick-up the approved leaf portions from said carrier and to carry them into a bobbin.

3 Claims, 2 Drawing Figures

Figure 1:
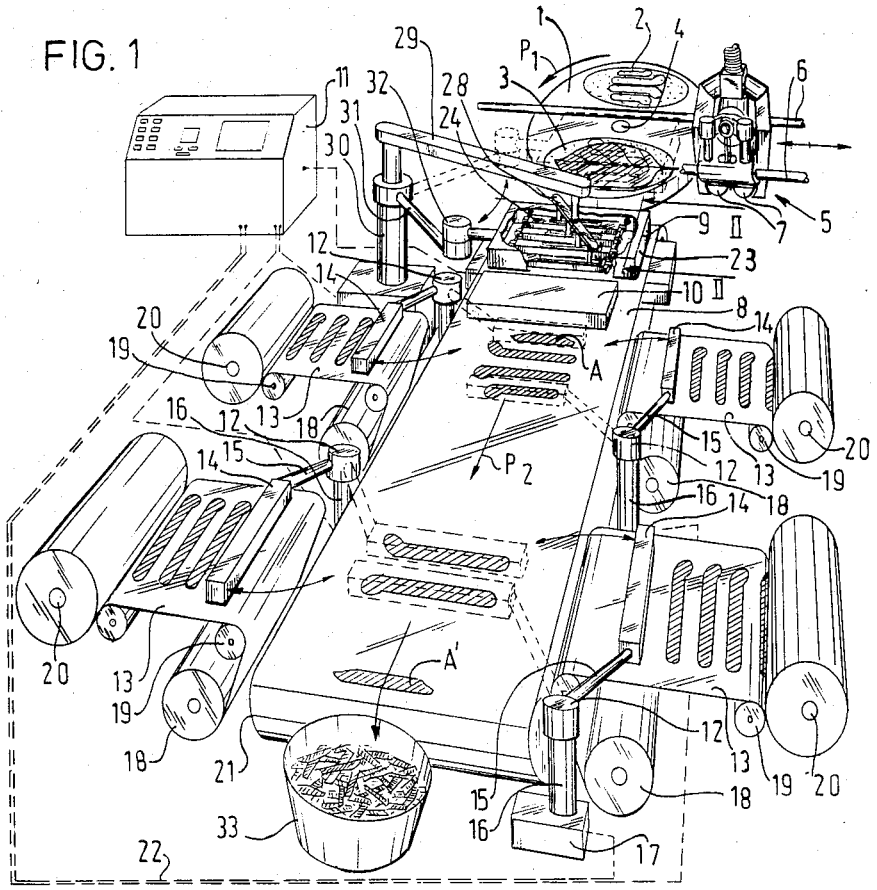

METHOD AND DEVICE FOR DIVIDING A WHOLE OR A HALF A TOBACCO LEAF INTO USABLE PORTIONS, FOR EXAMPLE, BINDERS OR WRAPPERS

This application is a continuation of application Ser. No. 162,431, filed 6/24/80, now abandoned.

The invention relates to a method of dividing a whole or half a tobacco leaf into usable portions, for example, binders or wrappers, in which the tobacco leaf is spread on two or more contour knives, the cutting edges of which are pressed across the material of the tobacco leaf.

In the cigar industry it is common practice to spread each tobacco leaf wholly or partly across a punching knife near the cutting station of a wrapping machine, after which the punched binder or wrapper is conducted to the wrapping nest for wrapping the leaf portion around the filler or bunch.

It is furthermore known to spread a whole or half a tobacco leaf simultaneously across two punching knives forming a complementary portion of a complete wrapper. The two tobacco leaf portions thus cut off by these punching knives are first united to a complete wrapper before being supplied to the wrapping nest.

It is finally known to conduct the tobacco leaf portions not directly to the wrapping nest, but first to a bobbin.

The above described cutting method has hitherto always required an operator who manually spread the tobacco leaf across the contour knives. The operator has to take care that the tobacco leaf does not exhibit damaged spots i.e. holes or cracks in the region inside the edges of the contour knives and, if necessary, it has to be ensured that no rips are found in the ends of the final wrapper.

The invention has for its object to provide a method in which manual spreading is maintained, it is true, but in which the operator need no longer give attention to the correct position of the wrapper on the contour knives. Neither need the operator pay attention to the fact whether the tobacco leaf is sufficiently large for covering all contour knives at the cutting station.

The method according to the invention is distinguished by lifting the punched tobacco leaf portions out of the contour knives, and by deposition of said portions on a carrier, by scanning each portion by means of a radiation source in order to obtain data with respect to the contour, the rip structure and/or defects in the leaf portion, by comparing these data with previously fixed standard data and finally by singling out the tobacco leaf portions corresponding to the standard data.

In this method the punched tobacco leaf portions are fully automatically checked the operator is relieved from an enormous task and the production can be materially raised. It is now possible to use an arbitrary number of contour knives, for example, four, the arbitrary shape of which may, moreover, be adapted to the mean size of the tobacco leaves to be worked.

In a further development of the method a number of tobacco leaf portions corresponding with the number of contour knives is deposited groupwise in a fixed pattern on the carrier, said pattern providing after scanning data to be compared with the standard data. Such a groupwise check of the tobacco leaf portions shortens the time required for working each leaf.

The invention furthermore relates to a device for carrying out the method described above, said device comprising a table having two or more contour knives and pressure elements co-operating with the former for pressing the cutting edges across the tobacco leaf material, said device being distinguished by a carrier arranged at the side of the table, a transport means operating between the contour knives and the carrier, a scanning device arranged near the carrier and having an electronic processing and control-circuit and by pick-up means controlled by the control-circuit for picking up the tobacco leaf portions corresponding to the standard data from the carrier.

It is known to arrange the contour knives at the cutting station near one another so that as many binders or wrappers as possible can be punched out of a tobacco leaf. In order to enable a rapid and effective check of the contour lines of the punched tobacco leaf portions the device according to the invention is furthermore provided with a transport means comprising a number of elongated suction boxes corresponding with the number of contour knives, said boxes being movable towards and away from one another in a transverse direction. With the aid of such transport means the punched tobacco leaf portions can be deposited at a distance from one another on the carrier so that the scan of the contour lines will not be disturbed.

In order to facilitate picking up the approved tobacco leaf portions and the evacuation of the leaf remnants the carrier is constructed in the form of an endless transport element driven by a driving member, whilst along the side(s) there are arranged a plurality of elements lifting the punched tobacco leaf portions, said pick-up elements and said driving member being relatively time-dependently controlled.

Preferably, each pick-up element is accompanied by a bobbin winding device, in which the approved and picked up tobacco leaf portions of identical kind are stored in a bobbin.

The invention will be described more fully with reference to an embodiment shown in the accompanying drawing.

The drawing shows in

Figure 2:
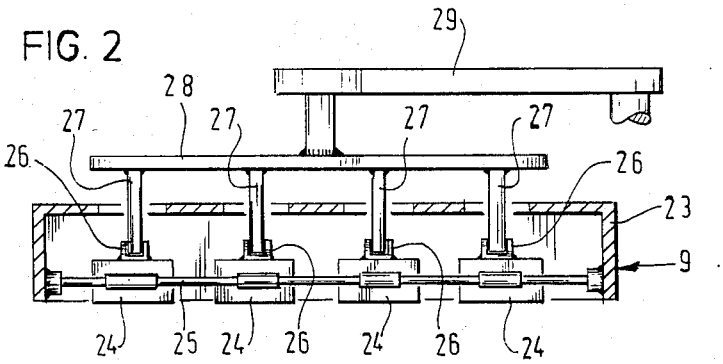

FIG. 1 a schematic, perspective plan view of an embodiment,

FIG. 2 a sectional view taken on the line II—II in FIG. 1 of the transport means used in the device shown in FIG. 1.

The device mainly comprises a table 1 having two diametrically opposite receiving surfaces 2, 3 for the deposition of a complete tobacco leaf. The receiving surfaces 2, 3 have each four contour knives, whose cutting edges just rise above the top side of the receiving surface, which surface has perforations communicating with a source of subatmospheric pressure.

The table 1 is adapted to turn about a vertical axis 4 so that the position of the receiving surfaces 2 and 3 can be varied. On the receiving surface 2 the operator spreads the tobacco leaf across the group of knives, whilst any expedient may be provided for stretching the tobacco leaf.

To the receiving surface 3 is associated a pressure element 5 in the form of a sledge adapted to be reciprocated along the slide paths 6. The pressure element 5 is provided on the bottom side with two cylindrical rollers 7, which come into contact with the cutting edges of the group of knives in the receiving surface 3 during the reciprocatory movement along the slide path 6. It will be obvious that during the reciprocatory movement a tobacco leaf deposited on the group is loaded so that the tobacco leaf portion located inside the edge of the contour knife is severed from the portion lying beyond said edge.

At the side of the turntable 1 there is arranged a carrier 8 in the form of an endless conveyor belt, whilst a transport means 9, which will be described in detail hereinafter, is operative between the receiving surface 3 and the beginning of the conveyor belt 8.

At the side of the beginning of the conveyor belt 8, above the same, a scanning camera, for example, a Reticon camera is arranged, which comprises a group of light-sensitive diodes responding to a light beam originating from the surface of the upper run of the conveyor belt 8, which beam may be produced by a light source arranged beneath the lower run or above the upper run. The Reticon camera is connected to an electronic processing and control circuit including an arithmetic device 11.

On both sides of the conveyor belt 8 are arranged four pick-up members 12 as well as a bobbin winding set 13 associated with each pick-up member. Each pick-up member 12 comprises a horizontal suction box 14, which is fastened by means of an arm 15 to a vertical stand 16. By means of a motor transmission mechanism 17 associated with each stand 16, each suction box 14 can be moved from a position indicated by solid lines into a position indicated by broken lines above the conveyor belt 8 and conversely.

Each bobbin winding set 13 comprises a holder for a reel 18 for an empty coil, two guide rollers 19 to form a horizontal receiving part of the tape winding member and a reel 20 for the filled bobbin.

The motor transmission systems 17 as well as the drive of the conveyor belt 8, which may drive the foremost reversing roller of FIG. 1, are controlled by the electronic processing circuit 11, which is indicated by the broken lines 33.

At the end of the conveyor belt 8, near the reversing roller 21, is arranged a waste recipient 22.

The device illustrated in FIG. 1 operates as follows.

As stated above, the operator deposits a complete tobacco leaf on the receiving surface 2 so that the major part of the tobacco material covers the knives of this area. After a signal the turntable 1 is turned through 180°, after which the pressure device 5 is actuated and the tobacco leaf is divided into usable and non-usable portions. At the pressure set 7 the surrounding parts of the tobacco leaf can be sucked away so that only the tobacco leaf inside the contour knives remains.

Then the transport means 9 picks up the punched-out tobacco leaf portions from the contour knives and deposits them on the beginning of the conveyor belt 8. During the movement of the belt 8 in the direction of the arrow P2 the group of punched-out tobacco leaf portions passes beneath the scanning camera 10, which collects data in respect of the contour lines of the tobacco leaf portions, the rip structure and/or the presence of holes or cracks, which data are further processed in the electronic processing unit 11. Therein the data obtained are compared with previously introduced standard data, after which the pick-up elements 12 together with the belt drive are controlled in relative time dependence so that a pick-up element each time picks up the tobacco leaf portion lying at the same place in the group and deposits the same on the horizontal run 13 of the winding belt. It will be obvious that the control-unit 11 actuates the pick-up element 12 only when the tobacco leaf portion concerned satisfies the standard data.

In FIG. 1 it is shown that a tobacco leaf portion on the receiving surface 3 does not completely cover the outermost cutting edge, which results in an incomplete wrapper part A, which is, therefore, not removed by the pick-up element 12 concerned. At the end of the belt 8 the tobacco leaf portion A′ is shown, which is conducted away to the waste bin 33.

It will be obvious that each time tobacco leaf portions of the same shape are thus stored in the tape winding members.

FIG. 2 shows a transport means 9 in a cross-sectional view, whose casing 23, which is open on the bottom side, accommodates four suction heads 24. Each suction head 24 is freely slidable in a transverse direction on a guide 25, which is supported on both sides in the casing 23. Each suction head 24 is provided on top with a U-shaped profile 26, in which a vertical pin 27 is freely displaceable by its lower end.

At the top end each pin 27 is fastened to a carrier 28, which is at a fixed angle to an arm 29 (see FIG. 1). The arm 29 is mounted in a freely pivotable manner on the top end of a vertical rotary spindle 30. At the top the vertical rotary spindle 30 is provided with an arm 31, which is coupled by means of a hinge 32 with the casing 23.

Driving and guiding are such that the casing 23, as stated above, can be moved from the receiving surface 3 to the beginning of the belt 8, the spacial position of the casing 23 remaining unchanged. Since the arm 29 is freely pivotable, it will change its position relative to the casing 23 together with the carrier 28. The pins 27 thus bring about a movement of the suction heads 24 away from and towards one another. The arrangement is such that the suction heads 24 are in contact with one another when the casing 23 is located above the receiving surface 3, whereas they are removed from one another when it is located above the beginning of the belt 8.

By this device it is ensured that the tobacco leaf portions picked up from the receiving surface 3, which are located near one another, are deposited on the belt 8 at a larger distance from one another. In this way an undisturbed scan by the camera 10 is ensured.

The invention is not limited to the embodiment described above. For example, more contour knives may be provided in each receiving surface and a correspondingly higher number of pick-up elements 12 and bobbin winding sets 13.

I claim:

1. The method of obtaining cigar wrappers from tobacco leaf, which comprises the steps of:

(a) manually placing a whole or half tobacco leaf in spread condition over a group of serially spaced wrapper cutting dies having a number of different sizes or shapes without attention to the correct position of the leaf on said dies whereby one or more of the dies may not be covered with tobacco leaf which is so free of defects or voids as would satisfy a predetermined standard;

(b) cutting wrapper portions from the leaf and then transferring the group of cut wrapper portions onto a longitudinally movable carrier in said serially spaced disposition along the direction of movement of the carrier;

(c) electronically scanning the group of cut wrappers and determining from data obtained thereby whether each cut wrapper satisfies said standard;

(d) advancing said carrier past a number of bobbin winding stations equal to said number of different sizes or shapes of cutting dies, each station having a web movable transversely away from the direction of movement of said carrier;

(e) transferring cut wrappers satisfying said standard and of a particular size or shape from said carrier onto the web of a station corresponding to such size or shape and moving said webs to space successive cut wrappers thereon; and (f) traveling cut wrappers which do not meet said standard past said stations to waste.

2. The method of obtaining cigar wrappers from tobacco leaf, which comprises the steps of:

(a) manually placing a whole or half tobacco leaf in spread condition over a group of spaced wrapper cutting dies having a number of different sizes or shapes without attention to the correct position of the leaf on said dies whereby one or more of the dies may not be covered with tobacco leaf which is so free of defects or voids as would satisfy a predetermined standard;

(b) cutting wrapper portions from the leaf and then transferring the group of cut wrapper portions onto a longitudinally movable carrier in spaced disposition thereon;

(c) electronically scanning the group of cut wrappers and determining from data obtained thereby whether each cut wrapper satisfies said standard;

(d) advancing said carrier past a number of transfer stations equal to said number of different sizes or shapes of cutting dies;

(e) at said transfer stations, transferring cut wrappers from said carrier which satisfy said standard and correspond to the particular size or shape of wrapper to which the transfer station corresponds; and (f) traveling cut wrappers which do not meet said standard past said stations to waste.

3. The method of obtaining cigar wrappers from tobacco leaf, which comprises the steps of:

(a) manually placing a whole or half tobacco leaf in spread condition over a group of spaced wrapper cutting dies having a number of different sizes or shapes without attention to the correct position of the leaf on said dies whereby one or more of the dies may not be covered with tobacco leaf which is so free of defects or voids as would satisfy a predetermined standard;

(b) cutting wrapper portions from the leaf and then transferring the group of cut wrapper portions onto a carrier;

(c) electronically scanning the group of cut wrappers and determining from data obtained thereby whether each cut wrapper satisfies said standard;

(d) transferring each cut wrapper of a particular size or shape from said carrier and which satisfies said standard to a discharge station corresponding to such size or shape; and (e) discharging cut wrappers which do not meet said standard to waste.

* * * * *